US006481206B1

(12) United States Patent
Pien

(10) Patent No.: US 6,481,206 B1
(45) Date of Patent: Nov. 19, 2002

(54) COMPOUND CYCLE INTERNAL COMBUSTION ENGINE

(76) Inventor: Pao C. Pien, 840 S. Collier Blvd., Marco, FL (US) 34145

( * ) Notice: Subject to any disclaimer, the term of this patent is extended or adjusted under 35 U.S.C. 154(b) by 0 days.

(21) Appl. No.: 09/953,201

(22) Filed: Sep. 17, 2001

(51) Int. Cl.[7] ..... F02G 3/00
(52) U.S. Cl. ..... 60/620; 60/623
(58) Field of Search ..... 60/620, 621, 623

(56) References Cited

U.S. PATENT DOCUMENTS 3,623,463 A * 11/1971 Vries ..... 92/176
3,672,160 A * 6/1972 Kim ..... 60/13
3,808,818 A * 5/1974 Cataldo ..... 60/620
3,924,576 A * 12/1975 Siewert ..... 60/620
4,023,365 A * 5/1977 Ginhoven ..... 60/614
4,541,246 A * 9/1985 Chang ..... 60/648
4,663,938 A * 5/1987 Colgate ..... 60/620
4,783,966 A * 11/1988 Aldrich ..... 60/621 X
4,918,923 A * 4/1990 Woollenweber et al. ..... 60/597
5,665,272 A * 9/1997 Adams et al. ..... 252/305

* cited by examiner

*Primary Examiner*—Hoang Nguyen
(74) *Attorney, Agent, or Firm*—Whiteford Taylor & Preston, LLP; Gregory M. Stone; Jeffrey C. Maynard

(57) ABSTRACT

A method for combusting fuel in an engine involving decreasing a first volume of a gas to a second volume while increasing a pressure and a temperature thereof, then increasing the second volume to a third volume at a constant pressure while adding heat until a predetermined temperature is obtained, and finally increasing the third volume to a fourth volume while adding more heat and decreasing the pressure thereof at the predetermined temperature. Also disclosed is a compound engine including an limited temperature cycle engine which produces exhaust that drives a Lenoir cycle apparatus.

13 Claims, 4 Drawing Sheets

COMPOUND CYCLE INTERNAL COMBUSTION ENGINE

BACKGROUND OF THE INVENTION

The present invention relates to constant-temperature combustion and a compound cycle and engine for operating on same.

Current combustion processes typically involved in constant-volume, constant-pressure or limited-pressure cycles occupy a small portion of the piston expansion stroke. Actual fuel combustion constitutes an extremely small portion of the cycle, thus generates a high firing temperature, but is not sufficient for complete combustion. As a result, current combustion processes promote formation of NOx and other harmful greenhouse gas.

Some internal combustion engines employ recycled exhaust gas (EGR engines) to lower the firing temperatures thereof and reduce NOx formation. However, the exhaust from EGR engines can not meet Federal emission standards without treating same with, for example, a catalytic converter.

Catalytic converters are labyrinthine duct-like structures lined with or constructed from materials that absorb undesired elements from exhaust coursing therethrough. Catalytic converters may be damaged or rendered ineffective when exposed to sulfur. To protect catalytic converters from sulfur damage, fuel combusted in the associated internal combustion engine must be treated to remove sulfur. De-sulfurizing fuel is expensive and problematic.

Accordingly, reducing NOx production without the expense or other difficulties occasioned by independent fuel or exhaust treatments, ideally, should address the combustion phase of an internal combustion engine cycle.

The combustion process may be described in terms of the ideal gas law:

$$PV=(M/n)*RT \quad (1)$$

where P is the pressure of the gas, V is the volume thereof, M is the mass thereof, n is the molecular weight thereof and T is the temperature thereof. When the volume of a perfect gas changes from a first volume $V_1$ to a second volume $V_2$, the ratios of the final pressure to the initial pressure, and the final temperature to the initial temperature are derived from:

$$P_2/P_1=(V_1/V_2)^k \quad (2)$$

$$T_2/T_1=(V_1/V_2)^{(k-1)} \quad (3)$$

where k is equal to $C_P/C_V$, $C_P$ being the specific heat at constant pressure and $C_V$ being the specific heat at constant volume. These ratios demonstrate that temperature changes much slower than the pressure with respect to the same volume change. It follows that, for the same volumetric expansion, far less heat is required to maintain a constant temperature than to maintain a constant pressure constant. Thus, for the same amount of heat added, a much larger volumetric expansion is needed to maintain constant temperature than to maintain constant pressure.

Also, maintaining constant temperature during combustion prolongs the time during which fuel actually is combusted, thus achieving more complete fuel combustion, which improves overall combustion efficiency.

Further, when the firing pressure is equal to or less than the compression pressure, the fuel-air mixture in the combustion chamber will have less tendency to leak into or remain in crevices and escape combustion. Equal firing and compression pressure also suppresses the tendency of the temperature behind the flame front from increasing due to increased pressure, which would promote NOx formation.

What is needed, and not taught or suggested by the prior art, is a method and an engine for promoting constant-temperature combustion.

SUMMARY OF THE INVENTION

The invention overcomes the limitations discussed above and provides a method and an engine for promoting constant-temperature combustion.

The invention provides for prolonging the time during which fuel actually is combusted during a combustion process, thereby improving overall combustion efficiency The invention limits firing pressure to be equal to or less than the compression pressure, thereby reducing major pollutant formation mechanisms.

To this end, the invention is a method for combusting fuel in an engine involving decreasing a first volume of a gas to a second volume while increasing a pressure and a temperature thereof, then increasing the second volume to a third volume at constant pressure while adding heat until a predetermined temperature is obtained, and finally increasing the third volume to a fourth volume while decreasing the pressure at the predetermined temperature. Increasing the third volume is accompanied by adding more heat, in an amount that sustains constant-temperature combustion. The invention also is a compound engine including a limited-temperature cycle internal combustion engine which produces exhaust and a Lenoir cycle apparatus operated by the exhaust.

Other features and advantages of the present invention will become apparent from the following description of the preferred embodiments which refers to the accompanying drawings.

BRIEF DESCRIPTION OF THE DRAWINGS

The invention is described in detail below with reference to the following figures, throughout which similar reference characters denote corresponding features consistently, wherein.

DESCRIPTION OF PREFERRED EMBODIMENTS

The invention is a method and an engine for promoting constant-temperature combustion. The method achieves constant-temperature combustion in sequential stages, a first stage under constant pressure, then a second stage under constant temperature. The engine includes a conventional four stroke direct injection (4SDI) internal combustion engine with energy input thereto metered for constant-temperature combustion by a modified conventional fuel injection system.

Figure 1:
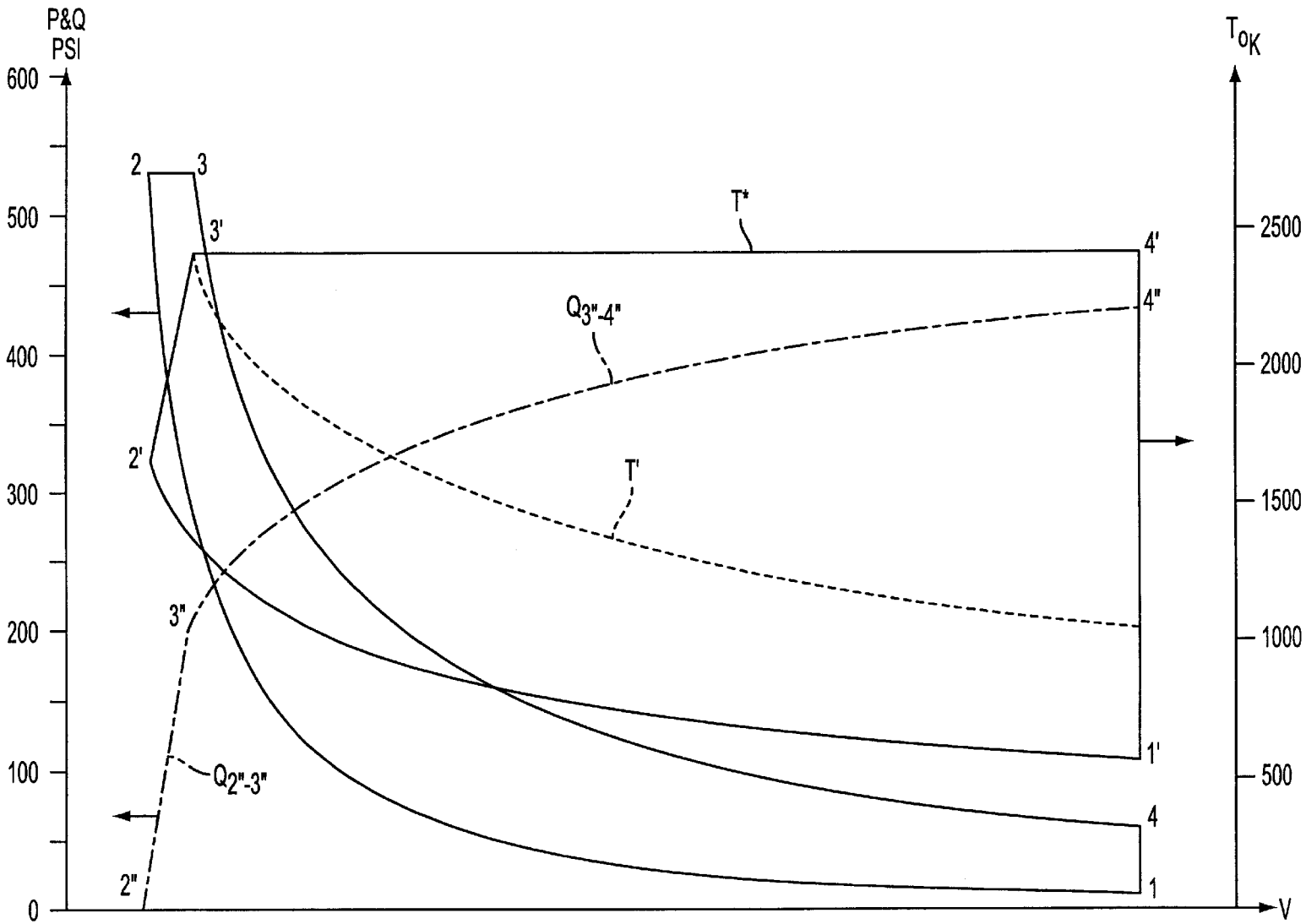
FIG. 1 is a graphical view of the relationships between pressure and volume, and temperature and volume of a limited-temperature cycle according to the invention, with pressure represented on the left-hand abscissa, temperature represented on the right-hand abscissa and volume represented on the horizontal abscissa therebetween.

FIG. 1 shows the relationships between pressure and volume, and temperature and volume of a limited-temperature cycle according to the invention. With respect to the relationship between pressure and volume, from point 1 to point 2, compression occurs with pressure increasing and volume decreasing. From point 2 to point 3, heat is added, i.e. fuel is combusted, at a constant pressure, until a limited temperature is obtained. From point 3 to point 4, heat is added at a constant temperature until the end of the expansion stroke. Finally, from point 4 back to point 1, heat is removed at constant volume.

The curve between points 3 and 4 is calculated according to:

$$P=(P_3*V_3)/V \tag{4}$$

which is based on the ideal gas law, equation 1 above.

Similarly, with respect to the relationship between temperature and volume, from point 1' to point 2', compression occurs, with temperature increasing and volume decreasing. From point 2' to point 3', heat is added, at a constant pressure, until a limited temperature is obtained. From point 3' to point 4', heat is added at a constant temperature until the end of the expansion stroke. Finally, from point 4' back to point 1', heat is removed at constant volume.

FIG. 1 also shows the amount of heat is added during the cycle. For example, the curve from point 2" to point 3", between points 2 and 3, or 2' and 3', represents the heat added under constant pressure, identified hereinafter as curve $Q_{2''-3''}$. The curve from point 3" to point 4" represents the heat added under a constant predetermined temperature T*, identified hereafter as curve $Q_{3''-4''}$. Thus, curve $Q_{3''-4''}$, represents the amount of heat needed for constant-temperature combustion and may be expressed as:

$$Q_{3''-4''}=C_V(T^*-T) \tag{5}$$

where T* is the desired predetermined temperature and T' is the theoretical adiabatic expansion temperature between points 3' and 4'.

An internal combustion engine configured for constant-temperature combustion alone would provide highly inefficient fuel consumption in view of output power therefrom. Combining such internal combustion engine with a power turbine, that is, a gas turbine engine without a turbine compressor and combustor, that operates according to a Lenoir cycle attains much greater efficiency.

Figure 2:
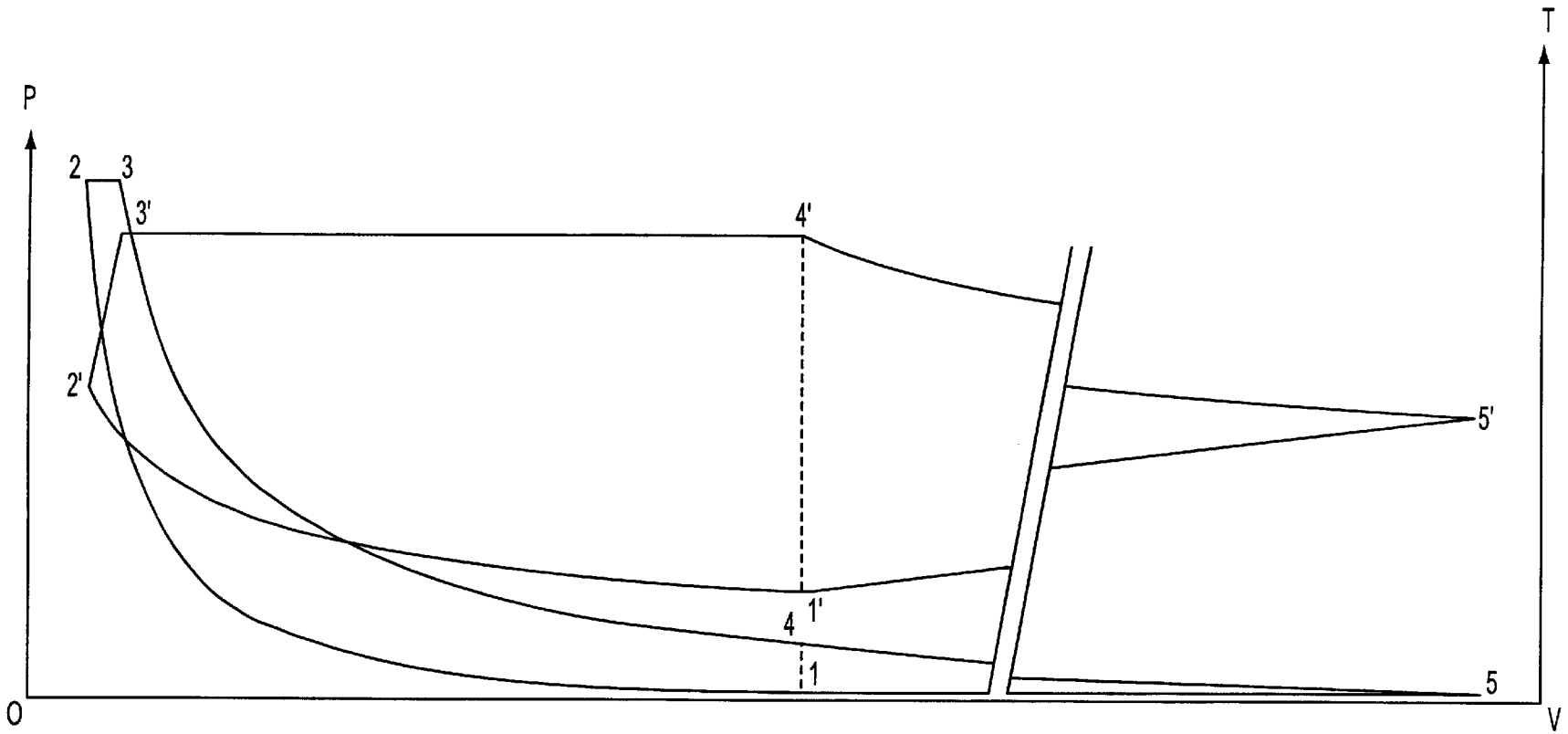
FIG. 2 is a graphical view of the relationships between pressure and volume, and temperature and volume of a limited-temperature cycle, as shown in FIG. 1, and a Lenoir cycle according to the invention.

FIG. 2 is a graphical view of the relationships between pressure and volume, and temperature and volume for a limited-temperature cycle and Lenoir cycle. The Lenoir cycle describes a pressure-volume curve defined by 1-4-5-1. From point 1 to point 4, pressure is increased by adding heat at a constant volume. From point 4 to point 5, pressure decreases while volume increases by adiabatic expansion. From point 5 to point 1, volume decreases at a constant pressure by removing heat. The heat removal process from point 4 to point 1 effectively cancels the heat addition process from point 1 to point 4, thereby providing a compound cycle that progresses through points 1-2-3-4-5-1. FIG. 2 also shows a temperature-volume curve 1'-2'-3'-4'-5'-1' of the foregoing compound cycle. From point 1' to point 2', the compound cycle provides compression. From point 2' to point 3' the compound cycle adds heat under a constant pressure. From point 3' to point 4', the compound cycle adds heat under a constant temperature. From point 4' to point 5', the compound cycle includes adiabatic expansion. From point 5' to point 1', the compound cycle removes heat under a constant pressure.

Figure 3:
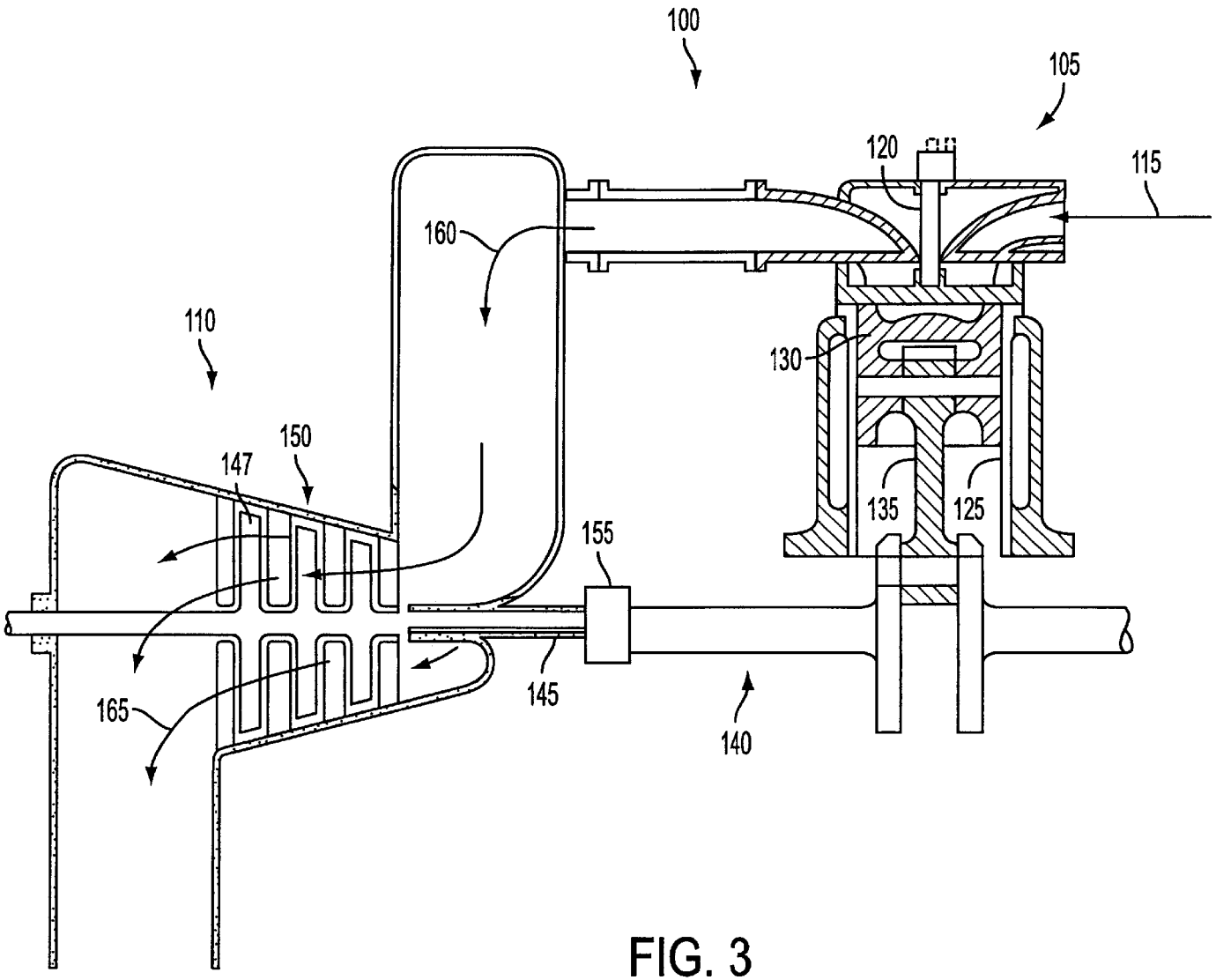
FIG. 3 is a partial cross-sectional view and partial schematic view of a piston-turbo shaft engine configured according to the invention.

FIG. 3 shows a schematic of a piston-turbo shaft engine 100 that operates on the compound cycle of the present invention. Engine 100 basically includes a limited-temperature cycle 4SDI engine 105, having a piston-crank power train, drivingly connected to a power turbine 110.

More specifically, engine 105 receives air 115, which is combined and combusted with fuel injected by a fuel injector 120, in cylinder 125. For ease of understanding, only one cylinder 125 and associated parts are shown. The reactive force caused by combustion of air 120 and the fuel against the piston 130 in cylinder 125 is transferred through a connecting rod 135 to and converted into torque in a crankshaft 140, described in greater detail below. Crankshaft 140 also receives torque from a turbine shaft 145 of power turbine 110. Crankshaft 140 may be drivingly connected to the power train of a vehicle, such as a passenger car or an airplane (not shown).

The exhaust 160 from cylinder 125 is received in and drives the rotor blades 147 of an expander 150 on turbine shaft 145 of power turbine 110.

Crankshaft 140 and turbine shaft 145 may be fixed directly if engine 105 and power turbine 110 are configured to rotate same at comparable speed. Alternatively, crankshaft 140 and turbine shaft 145 may be linked through a gear box 155 which accommodates rotational speed differences therebetween.

As discussed above, the cycle of compound engine 100 provides for combusting fuel at a constant temperature. The temperature may be controlled to be high enough to assure complete fuel combustion, yet low enough to prevent NOx formation.

Figure 4:
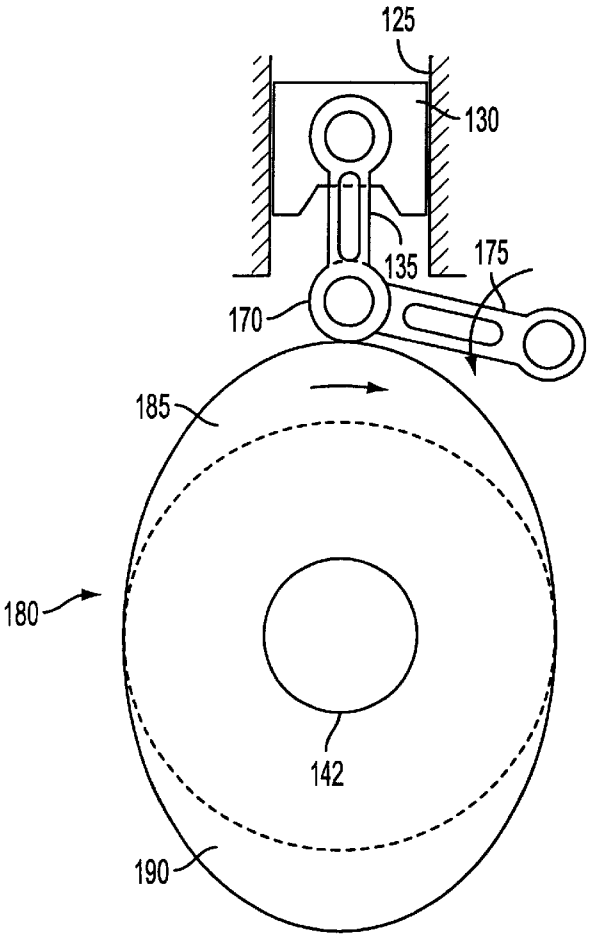
FIG. 4 is a schematic view of a piston, connecting rod, cam follower, oscillating arm, cam and cam shaft of a piston-cam powertrain.

Although any existing 4SDI engine can be converted into a limited-temperature cycle 4SDI engine, the full advantages of the present compound engine may be more fully achieved with a piston-cam assembly power train, as provided in U.S. Pat. No. 6,125,802, which is incorporated herein, as shown in FIG. 4. FIG. 4 shows a schematic view of piston 130, connecting rod 135, cam follower 170, oscillating arm 175, cam 180 and camshaft 142. Cam 180 may have two lobes 185 and 190 so that each rotation of camshaft 142 generates four piston strokes with the intake and exhaust valves (not shown) opening and closing once. Accordingly, valve-operating auxiliary cams (not shown) may rotate at the same speed as camshaft 142. Thus, the two auxiliary cams may be drivingly connected to camshaft 142, eliminating the need for a separate camshaft.

For increasing volumetric efficiency and reducing pumping losses, the auxiliary cams should have a large base circle with circular arc lobe profiles. This provides high volumetric efficiency and reduces pumping losses. Multiple cylinders may be arranged around camshaft 142, in columns and rows or rings, depending on the total power output required.

Regardless of the configuration and arrangement of the power train elements, crankshaft 140 rotates at a rate that corresponds to the position of piston 130 relative to cylinder 125. Thus, the position of crankshaft 140 corresponds to the volume expansion rate in cylinder 125. As described below, the amount of fuel to be injected for constant-temperature combustion can be tied to the volume defined by piston 130 and cylinder 125. Thus, constant-temperature fuel injection can be tied to crankshaft or cam shaft orientation. Therefore, any internal combustion engine may be converted into a constant-temperature combustion engine according to the invention by coordinating the fuel injection rate with the position of crankshaft 140.

As described above in conjunction with FIG. 1, curve $Q_{3''-4''}$ represents the amount of heat needed for constant-temperature combustion, which may be calculated according to equation 5 above. $P_2$, $T_2$ and $V_2$ are computed from $P_1$, $T_1$ and $V_1$, as discussed above, based on the compression ratio for the engine. At point 3, $P_3=P_2$ and $T_3$ and $V_3$ are calculated from:

$$T_3=T_2+Q_{2''-3''}/C_P \quad (6)$$

$$V_3=V_2(T_3/T_2) \quad (7)$$

Between points 3 and 4, T' is calculated according to:

$$T'=T^*(V_3/V(\theta))^{(k-1)} \quad (8)$$

which, when substituted into equation 5 above, yields:

$$Q_{3''-4''}=C_V T^*(1-(V_3/V(\theta))^{(k-1)} \quad (9)$$

Thus, providing an extant internal combustion engine with a fuel injection system that injects fuel injection according to equation 9, which requires only one input in addition to the traditional inputs, the cam shaft or crankshaft rotational angle θ, can achieve the present limited-temperature combustion process.

For a piston-crank power train, V(θ) depends on crank radius, connecting rod length and crank angle. For a piston-cam power train, V(θ) is a function of cam profile, which is a function of shaft angle θ.

For automotive applications, an existing gasoline direct injection (GDI) engine can be converted to operate with a limited-temperature cycle by re-programing, modifying or replacing the existing fuel injection system so as to be capable of coordinating fuel injection rate with cylinder volume change for constant-temperature combustion, according to formula 9 above, and combining the GDI engine with a power turbine, as shown in FIG. 3.

As an example, where the temperature at which constant-temperature combustion is T*=2400 K, at point 1, $V_1$=15.6 cubic feet, $P_1$=14.7 psi, and $T_1$=560 K. For a limiting temperature T* of 2400 K, the preferred compression ratio is 13. At point 2, $V_2$=1.2 cubic feet, $P_2$=533 psi, and $T_2$=1562 K. Between points 2 and 3, heat is added under a constant pressure $Q_{2''-3''}$=201 Btu/lbm until the temperature equals T*. At point 3, $V_3$=1.84 cubic feet, $P_3$=533 psi, and $T_3$=2400 K. Between points 3 and 4, heat is added at a constant temperature of 2400 K, $Q_{3''-4''}$=236 Btu/lbm. At point 4, $V_4$=15.6 cubic feet, $P_4$=62.9 psi, $T_4$=2400 K. Between points 4 and 5, adiabatic expansion takes place. At point 5, $V_5$=44.1 cubic feet, $P_5$=14.7 psi, $T_5$=1342 K. Between points 5 and 1, heat is removed at constant exhaust pressure with $Q_{5''-1''}$=−187.7 Btu/lbm. The thermal efficiency of the cycle is 57%. The GDI engine contributes slightly less than half of the total output.

At one-third power output, $Q_{2''-3''}$=145.6 Btu/lbm, the firing pressure is as low as $P_3$=533 psi and the firing temperature is as low as $T_3$=2169 K. No combustion occurs at other than the constant firing pressure. The compound engine operates on a compound cycle 1-2-3-5-1 with a pressure ratio of 36.3 and a cycle efficiency of 64.2%.

Because the present compound engine has a maximum pressure of 533 psi and undergoes small rates of pressure change, the present engine may run very quietly and smoothly. Because engine parts will experience much smaller mechanical and thermal stresses, reciprocating engine parts may be pared considerably and engine friction losses reduced. Consequently, engine rotational speed may be increased to boost engine power density. An engine configured accordingly will last longer with far less maintenance than required for conventional internal combustion engines.

The present compound engine also is superior to current hybrid gasoline-electrical power plants. In such designs the gasoline engine portion can not reduce incylinder NOx emission levels to meet Federal emission standards without aftertreatment, and there is always some energy loss whenever mechanical energy is converted to electrical energy and vice versa. The present compound engine more completely combusts fuel introduced therein and minimizes NOx emissions without the need of EGR techniques.

Figure 6:
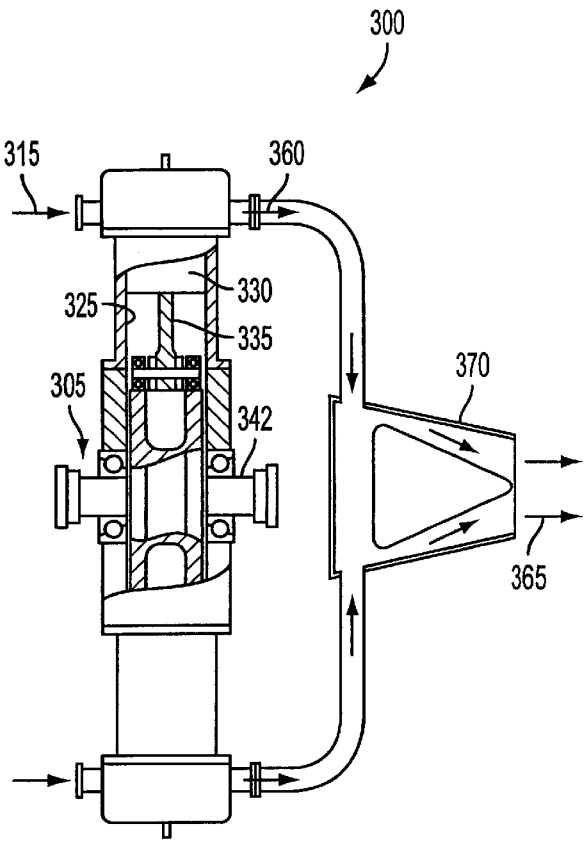
FIGS. 5 and 6 respectively are schematic views of drive train and jet propulsion applications according to the invention.
Figure 5:
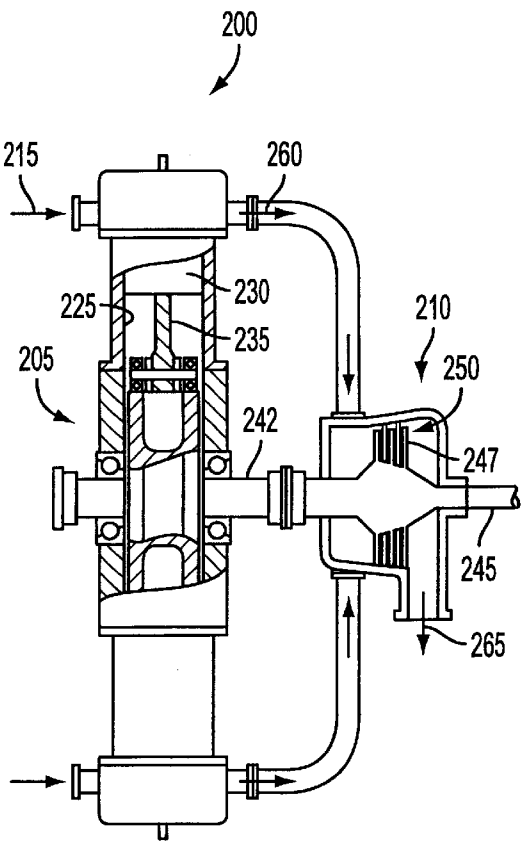

FIGS. 5 and 6 respectively show drive train and jet-propulsion applications for the invention. The embodiment 200 of FIG. 5 corresponds to the embodiment 100 of FIG. 3, but with a piston-cam rather than a piston-crank power train. Engine 205 receives air 215, which is combined and combusted with fuel injected by a fuel injector (not shown), in a plurality of radial or annularly-diverged cylinders 225. The reactive force caused by combustion of air 220 and the fuel against each piston 230 in each respective cylinder 225 is transferred through connecting rod 235 to and converted into torque in camshaft 242. Camshaft 242 also receives torque from turbine shaft 245 of power tanks 210. Camshaft 242 may be drivingly connected to the power train of a vehicle. The exhaust 260 from each cylinder 225 is received in and drives rotor blades 247 on turbine shaft 245 of expander 250 of power turbine 210. In addition, camshaft 242 may be coupled to a propeller (not shown) or a fan (not shown).

FIG. 6 shows an embodiment 300 that generally corresponds to the embodiment 200 of FIG. 5, differing in that embodiment 300 does not include an expander, like expander 250 in FIG. 5. Instead, an exhaust duct 370 receives exhaust 360 from engine 305. Exhaust duct 370 contours and directs exhaust 360 in a manner that provides forward thrust.

The ratio between power derived from camshaft 342 and power derived from the thrust of exhaust 365 is determined by the exhaust pressure. When camshaft power is harnessed entirely to compress the products of combustion, thereby increasing the enthalpy of exhaust 360, the net power output of engine 305 becomes zero and camshaft 342 rotates by itself. In other words, engine 305 may be tuned to operate only to produce and supply hot gas through exhaust duct 370 to generate forward thrust, defining a piston-jet engine.

Compared with a turbojet engine, advantages of a piston-jet engine are numerous. The specific air mass flow through a piston-jet engine is only a small fraction of that through a turbojet engine. Thus, a piston-jet engine has a power density that approaches that of a turbojet engine. Also, the manufacturing cost of a 4SDI engine is significantly less than a gas turbine engine. Furthermore, a 4SDI engine can be maintained and serviced with ordinary equipment and skill.

Although the invention has been described in relation to particular embodiments thereof, many other variations and modifications and other uses will become apparent to those skilled in the art. The invention is not limited by the specific disclosure herein, but only by the appended claims.

I claim:

1. A compound, limited temperature cycle for operating an engine comprising:

a compression process 1-2;

a heat addition process 2-3-4, said heat addition process 2-3-4 further comprising, a first heat addition process 2-3 carried out via injection and combustion of fuel in a cylinder of said engine while maintaining a constant pressure and while increasing volume in said cylinder; and a second heat addition process 3-4 carried out via injection and combustion of fuel in said cylinder while maintaining a constant, limited temperature and while increasing volume in said cylinder;

an adiabatic expansion process 4-5; and a constant pressure heat remove process 5-1;

wherein said compression process, said heat addition process, said adiabatic expansion process, and said constant pressure heat remove process combine to form a compound, limited temperature cycle 1-2-3-4-5-1.

2. A method for combusting fuel in an engine comprising:

decreasing a first volume of a gas to a second volume while increasing a pressure and a temperature thereof;

increasing the second volume to a third volume at constant pressure while adding a first amount of heat via injection and combustion of fuel in a cylinder of said engine until a predetermined temperature is attained; and increasing the third volume to a fourth volume while adding a second amount of heat via injection and combustion of fuel in said cylinder and decreasing the pressure thereof while maintaining the temperature constant at the predetermined temperature.

3. The method of claim 2, wherein a firing pressure is substantially equal to or less than a compression pressure.

4. The method of claim 2, wherein said second amount of heat corresponds to $Q=C_V(T^*-T')$ or $Q=C_VT^*(1-V_3/V(\theta))^{(k-1)}$); wherein Q is said second amount of heat;

$C_V$ is the specific heat of said gas at constant volume;

$T^*$ is said predetermined temperature;

T' is a theoretical adiabatic expansion temperature occurring when increasing said third volume to said fourth volume;

$V_3$ is said third volume;

$V(\theta)$ is a volume between said third and fourth volume, and is a function of angle θ of a crank or cam associated with said engine; and k is $C_P/C_V$, where $C_P$ is the specific heat of said gas at constant pressure.

5. An engine comprising:

a limited-temperature cycle engine adapted to produce exhaust, said limited-temperature cycle engine being configured to combustion fuel by:

decreasing a first volume of a gas to a second volume while increasing a pressure and a temperature thereof;

increasing the second volume to a third volume at constant pressure while adding a first amount of heat via injection and combustion of fuel in a cylinder of said engine until a predetermined temperature is attained; and increasing the third volume to a fourth volume while adding a second amount of heat via injection and combustion of fuel in said cylinder and decreasing the pressure thereof while maintaining the temperature constant at the predetermined temperature; and a power turbine adapted to be driven by the exhaust.

6. The engine of claim 5, further comprising a shaft drivingly connected to said limited temperature cycle engine, said shaft being drivingly connectable to an expander of said power turbine.

7. The engine of claim 6, said shaft being adapted for driving a fan, a propeller, or a power train of a vehicle.

8. The engine of claim 5, wherein a firing pressure is substantially equal to or less than a compression pressure.

9. The engine of claim 5, wherein said second amount or heat corresponds to $Q=C_V(T^*-T')$ or $Q=C_VT^*(1-V_3/V(\theta))^{(k-1)}$); wherein Q is said second amount of heat;

$C_V$ is the specific heat of said gas at constant volume;

$T^*$ is said predetermined temperature;

T' is a theoretical adiabatic expansion temperature occurring when increasing said third volume to said fourth volume;

$V_3$ is said third volume;

$V(\theta)$ is a volume between said third and fourth volume, and is a function of angle θ of a crank or cam associated with said engine; and k is $C_P/C_V$, where $C_P$ is the specific heat of said gas at constant pressure.

10. An engine comprising:

a limited-temperature cycle engine, having a cam shaft, adapted to produce exhaust, said limited-temperature cycle engine being configured to combust fuel by:

decreasing a first volume of a gas to a second volume while increasing a pressure and a temperature thereof;

increasing the second volume to a third volume at constant pressure while adding a first amount of heat via injection and combustion of fuel in a cylinder of said engine until a predetermined temperature is attained; and increasing the third volume to a fourth volume while adding a second amount of heat via injection and combustion of fuel in said cylinder and decreasing the pressure thereof while maintaining the temperature constant at the predetermined temperature; and an exhaust duct in fluid communication with an exhaust port of said engine and receiving hot exhaust gas therefrom, said exhaust duct configured to divert said hot exhaust gas therethrough to generate thrust.

11. The engine of claim 10, wherein said limited temperature cycle engine is configured to compress combustion products with a compression that substantially eliminates cam shaft power and correspondingly increases power of the exhaust.

12. The engine of claim 10, wherein a firing pressure is substantially equal to or less than a compression pressure.

13. The engine of claim 10, wherein said second amount of heat corresponds to $Q=C_V(T^*-T')$ or $Q=C_VT^*(1-V_3/V(\theta))^{(k-1)}$); wherein Q is said second amount of heat;

$C_V$ is the specific heat of said gas at constant volume;

$T^*$ is said predetermined temperature;

T' is a theoretical adiabatic expansion temperature occurring when increasing said third volume to said fourth volume;

$V_3$ is said third volume;

$V(\theta)$ is a volume between said third and fourth volume, and is a function of angle θ of a crank or cam associated with said engine; and k is $C_p/C_V$, where $C_p$ is the specific heat of said gas at constant pressure.

* * * * *